US010161608B2

(12) United States Patent
Pallai

(10) Patent No.: US 10,161,608 B2
(45) Date of Patent: Dec. 25, 2018

(54) HIDDEN LIGHTING UNDER A SHELF

(71) Applicant: EKLIPSE LUMINAIRE ARCHITECTURAL INC., Montreal (CA)

(72) Inventor: Andre Pallai, Montreal (CA)

( * ) Notice: Subject to any disclaimer, the term of this patent is extended or adjusted under 35 U.S.C. 154(b) by 0 days.

(21) Appl. No.: 15/821,415

(22) Filed: Nov. 22, 2017

(65) Prior Publication Data

US 2018/0142869 A1 May 24, 2018
US 2018/0299107 A9 Oct. 18, 2018

Related U.S. Application Data

(60) Provisional application No. 62/425,427, filed on Nov. 22, 2016.

(51) Int. Cl.

| | |
|---|---|
| ***F21V 33/00*** | (2006.01) |
| ***F21V 21/096*** | (2006.01) |
| ***F21V 23/00*** | (2015.01) |
| ***F21V 3/00*** | (2015.01) |
| *F21Y 115/10* | (2016.01) |

(52) U.S. Cl.
CPC ..... *F21V 21/096* (2013.01); *F21V 3/00* (2013.01); *F21V 23/005* (2013.01); *F21Y 2115/10* (2016.08)

(58) Field of Classification Search
CPC ..... A47F 11/10; A47F 5/0043; A47F 5/103; F21V 33/0012
USPC ..... 362/133, 127
See application file for complete search history.

(56) References Cited

U.S. PATENT DOCUMENTS

| | | | | |
|---|---|---|---|---|
| 4,689,726 | A | 8/1987 | Kretzschmar | |
| 6,276,810 | B1 * | 8/2001 | Vosshenrich | A47F 11/10 362/125 |
| 6,364,273 | B1 * | 4/2002 | Otema | A47F 5/0043 248/235 |
| 8,215,795 | B2 | 7/2012 | Pichel | |
| 9,222,645 | B2 | 12/2015 | Breslow et al. | |
| 2007/0291480 | A1 | 12/2007 | Sherman | |
| 2008/0285260 | A1 | 11/2008 | Sherman | |

FOREIGN PATENT DOCUMENTS

| | | |
|---|---|---|
| EP | 2641508 | 9/2013 |
| EP | 2842461 | 3/2015 |

* cited by examiner

*Primary Examiner* — Jamara Franklin
(74) *Attorney, Agent, or Firm* — Benoit & Cote, Inc.; C. Marc Benoit

(57) ABSTRACT

A lit shelf system comprising a shelf having a front face, a lighting face extending horizontally, a dark face opposite the lighting face and a groove. The groove has a front wall extending to a front edge about the lighting face and a rear wall extending to a rear edge about the lighting face. The front wall is closer to the front face than the rear wall and the front wall extends further from the dark face than the rear wall. The lit shelf system further comprises a light source mounted in the groove and being for lighting a space about the lighting face. The light source extends between the front wall and the rear wall past the rear edge but not past the front edge.

20 Claims, 6 Drawing Sheets

HIDDEN LIGHTING UNDER A SHELF

CROSS-REFERENCE TO RELATED APPLICATION

This application claims priority from U.S. patent provisional application 62/425,427 filed Nov. 22, 2016, the specification of which is hereby incorporated herein by reference in its entirety.

BACKGROUND (a) Field

The subject matter disclosed generally relates to lighting devices. More particularly, the subject matter disclosed relates to lighting fixtures and lit displays.

(b) Related Prior Art

In the field of lighting, and particularly in the field of lit shelves, there have been many attempts to devise solutions that provide better light area/space coverage under a shelf. Some of these solutions are voluminous, complex to install, or do not resolve the problem according to expectations. For instance, some of them do not succeed to light up the whole area. For example, U.S. Patent Publication U.S. 2007/0291480 lights up the area under the shelf but a shadow line remains on the top of the wall behind the shelf.

Other examples of attempts to provide the highest quality in display lighting under shelves include U.S. Pat. Nos. 4,689,726 A, 8,215,795 B2, 8,506,116 B2, 9,222,645 B2, U.S. Patent Publication U.S. 2008/0285260, European Patent Publication EP 2842461 A1 and European Patent Publication EP 2641508 A1, which all provides attempts to solve this problem with adapted shelves or additional lighting components to affix to the shelves or along the shelves.

There is therefore a need for improvements in the field of lighting in shelf arrangements that overcome the drawbacks associated with the existing solutions.

SUMMARY

According to an embodiment, there is disclosed a lit shelf system comprising: a shelf having a front face, a lighting face extending horizontally, a dark face opposite the lighting face and a groove, the groove having a front wall extending to a front edge about the lighting face and a rear wall extending to a rear edge about the lighting face, the front wall being closer to the front face than the rear wall and the front wall extending further from the dark face than the rear wall; and a light source mounted in the groove and for lighting a space about the lighting face, the light source extending between the front wall and the rear wall past the rear edge but not past the front edge.

According to an aspect, the groove is within the lighting face.

According to an aspect, lighting face comprising a frontmost face and a rearmost face on either side of the groove, the frontmost face being closer to the front face than the rearmost face.

According to an aspect, the front wall extends further from the dark face than the rear wall by a given distance, further wherein the frontmost face extends from the dark face by a given thickness, wherein the given distance represents less than 3% of the given thickness.

According to an aspect, the front wall extends further from the dark face than the rear wall by a given distance, further wherein the frontmost face extends from the dark face by a given thickness, wherein the given distance represents less than 5% of the given thickness.

According to an aspect, the front wall extends further from the dark face than the rear wall by a given distance, further wherein the frontmost face extends from the dark face by a given thickness, wherein the given distance represents less than 10% of the given thickness.

According to an aspect, the front wall and the rear wall extending substantially vertically.

According to an aspect, the front wall and the rear wall extending substantially vertically and straight.

According to an aspect, when the light source is mounted within the groove it does not extend past the front edge.

According to an aspect, the light source is mounted within the groove by friction.

According to an aspect, the space lit by the light source spreads over an angle of coverage in a plane which is normal to both the front face and the lighting face, the angle of coverage having a central axis directed substantially away from the shelf and in a direction opposite the front face.

According to an aspect, the space lit by the light source spreads over an angle of coverage in a plane which is normal to both the front face and the lighting face, the angle of coverage being greater than 100 degrees.

According to an aspect, the space lit by the light source spreads over an angle of coverage in a plane which is normal to both the front face and the lighting face, the angle of coverage being greater than 130 degrees.

According to an aspect, the light source further comprises a casing and light emitting component mounted within the casing.

According to an aspect, the light source further comprises a diffuser film mounted within the casing to diffuse the light emitted by the light emitting component.

According to an aspect, the lit shelf system further comprises a magnet and wherein the light source is mounted within the groove using an electromagnetic force holding the casing within the groove.

According to an aspect, the lighting component comprises one or more LEDs.

According to an aspect, the space lit by the light source spreads over an angle of coverage in a plane which is normal to both the front face and the lighting face, the angle of coverage having a central axis directed substantially away from the shelf and in a direction opposite the front face, wherein the casing comprises a front wall ending at a front edge wherein the angle of coverage is limited in one direction by lighting face and another direction by a border line which is limited by the front edge.

According to an aspect, the central axis and the border line define an angle which is 70 degrees or more.

According to an aspect, the front wall and the rear wall extend downwardly and the lighting space is below the shelf.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
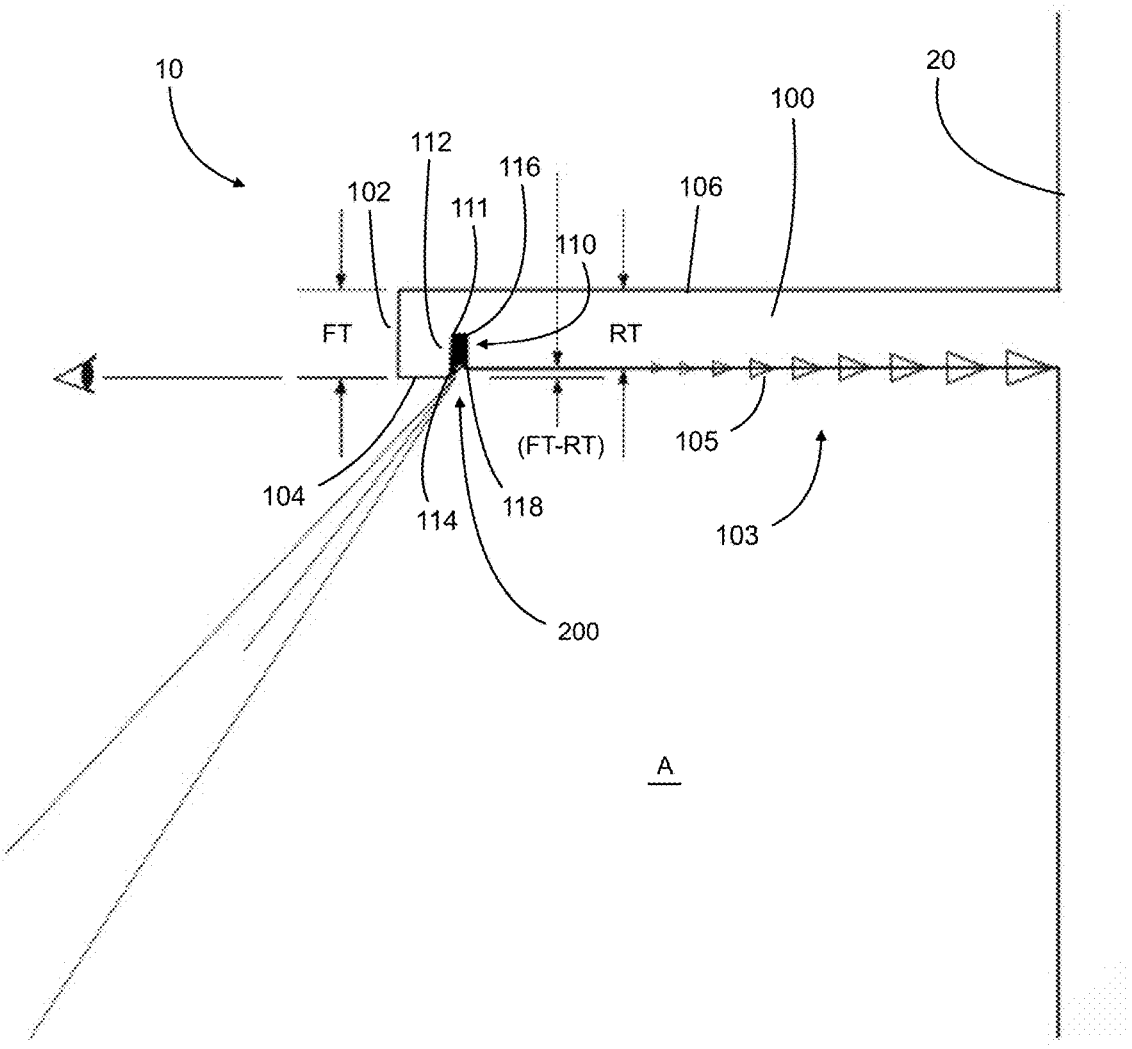
FIG. 1 is an illustration of a side view of a lit shelf system in accordance with an embodiment.

Referring now to the drawings, and more particularly to FIG. 1, there is shown a lit shelf system 10 adapted to provide lighting under a shelf 100 with the light spreading homogeneously in a display area, a.k.a. lit area A, under the shelf 100. The lit area A is located under the shelf 100 as looked at by an observer located in front of the shelf 100 from a typical perspective looking at the space below the shelf 100.

It will be understood that other embodiments where the lit area A which is lit is above the shelf 100 are also possible. In such circumstances, the lit shelf system 10 described herein is simply turned upside down; i.e., the top becomes the bottom and vice versa. Such embodiments are useful and possible as long as the blind angle is respected; i.e., the angle within which the observer cannot see the light source 200 (see FIG. 2). Nonetheless, for explanation purposes, the lit area A being located under the shelf 100 is used hereinafter.

Referring to FIG. 1, the lit shelf system 10 comprises a shelf 100 having a front face 102, a lighting face 103 and a top face 106. The lighting face 103, illustrated in the embodiment as an underface, comprises a frontmost underface 104, a rearmost underface 105. The distance between the top face 106 and the frontmost underface 104 defines a front shelf thickness FT. The distance between the top face 106 and the rearmost underface 105 defines a second thickness, a rear shelf thickness RT. The thickness FT is greater than the thickness RT. The top face 106 also known being opposite the lighting face 103 as the dark face.

According to an embodiment, a difference in the level of the frontmost underface 104 and the rearmost underface 105, thus between the thickness FT and the thickness RT, of about 2 mm (about 0.100 of an inch) provides the desired result, namely to obtain an almost imperceptible difference between the frontmost underface 104 and the rearmost underface 105 and thereby providing the illusion to one observer of a single uniform continuous lighting underface 103.

The shelf 100 is mounted (either in a removable manner or permanently) to an anchoring wall 20 using a known method such as screws, bolts, clips, a combination of anchoring components and anchor-receiving structures, or any other known alternative.

The perspective of an observer of the shelf 100 consists in one looking at the front face 102 of shelf 100 from a distance. Depending on the height at which the shelf 100 is installed as the height and position of the observer, a variety of typical perspectives of an observer looking at the shelf 100 or at the lit area A lit by the lit shelf system 10 must be considered. The lit area A is also referred to herein as the lit space or simply the space.

Still referring to FIG. 1, the shelf 100 comprises a groove 110 located close to the front face 102 and separating the frontmost underface 104 of the shelf 100 having a front shelf thickness FT from the rearmost underface 105 of the shelf 100 having a rear shelf thickness RT. The groove 110 has a depth that is smaller than the rear shelf thickness RT (typically about 0.5 of an inch) from the frontmost underface 104), thereby having the groove 110 encased in the shelf 100. The groove 110 has a bottom 111, a front wall 112 and a rear wall 116. The groove 110 has a width between its front wall 112 and its rear wall 216, according to an embodiment, of about 3/16 of an inch. Junction between the front wall 112 and the frontmost underface 104 defines a front edge 114. The junction between the rear wall 116 and the rearmost underface 105 defines a rear edge 118.

Figure 2:
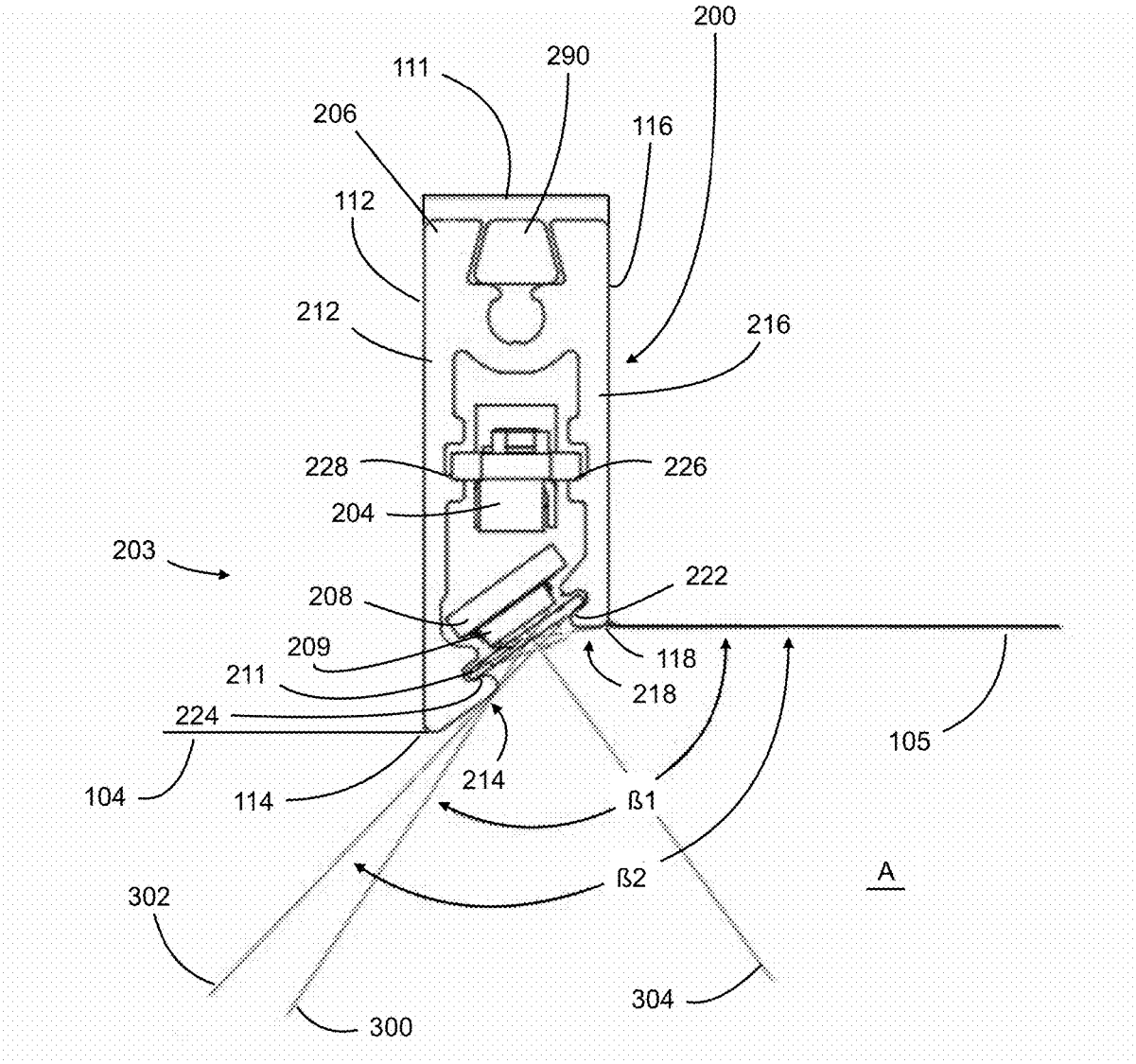
FIG. 2 is a close-up illustration of the side view of the lit shelf system of FIG. 1.

Referring additionally to FIG. 2, the light source 200 is encased in the groove 110, thus close to the front face 102. The light source 200 emit a beam of light downwardly at a spreading angle ß2 delimited on one side by the rearmost underface 105 alongside which the beam of light runs, and on the other side by a lit limit defined as explained below.

Accordingly, still referring to FIG. 1, a typical observer, who would normally have their eyes between somewhere above the level of the shelf 100 and slightly under the shelf 100, cannot directly see the light source 200 (or in other words does not have light emitted directly in direction of their eye). Furthermore, the beam of light reaches the junction between the rearmost underface 105 and the anchoring wall 20 uninterrupted. By having the beam of light traveling uninterruptedly to the junction of the rearmost underface 105 and the anchoring wall 20, the lit shelf system 10 eliminates a shadow line that is typically present with typical lit shelves of the prior art.

Referring particularly to FIG. 2, the light source 200 is encased in the groove 110. The light source 200 comprises a light casing 206 comprising a front wall 212 and a rear wall 216. The light casing 206 is housed between the front wall 112 and the rear wall 116. The light casing 206 is maintained into the groove 110, according to embodiments, through different solutions. According to one embodiment, the light casing 206 is maintained in the groove 110 through the use of a metallic strip installed at the bottom 111 of the groove 110 and a magnet 290 secured to the top of the light casing 206. According to another embodiment, the light casing 206 is forced into the groove 110, with a biasing means such as a compressible component, such as an elastomer component, affixed to at least one of the front wall 212 and rear wall 216 of the light casing 206, with by the front wall 112 and the rear wall 116 of the groove 110 applying an inward force on the casing 206 to maintain the casing 206 within the groove 110. The casing 206 further comprises a front edge 214 ending the front wall 212, and a read edge 218 ending the rear wall 216. The front edge 214 and the rear edge 218, in a limiting manner, are extending inwardly.

The light source 200 comprises a light component 203. The light component 203 comprises a functional combination of at least part of a driver 204 electrically connected to a light emitting component 209, the light emitting component 209 (embodied in the present embodiment as one or more Light Emitting Diodes or LEDs, and further referred to herein as LED 209) and a printed circuit board (a.k.a. PCB) 208 electrically connected to the driver 204 and controlling the LED 209. According to an embodiment (see FIGS. 4 to 6), the boards of PCB 208 and the driver 204 are regularly electrically connected along their length; the connections performing both functions of electric bridges and physical bridges maintaining the boards both distant and together as a single structure.

The light source 200 further comprises a diffuser film 211 disposed in front of the LED 209. The diffuser film 211, by its nature and configuration, direct and control the spreading of the beam of light according to the light spreading angle ß2. The light casing 206 further comprises a housing configuration, abutment or other structural or fastening components adapted to house and maintain the driver 204, the PCB 208, the LED 209 and the diffuser film 211 in place and in the desired orientation within the light casing 206. According to the illustrated embodiment, the casing 206 comprises a series of abutments 222, 224, 226 and 228 against which the diffuser film 211 and the driver 204 are abutting.

The light casing 206, when mounted in the groove 110 of the shelf 100, further presents itself extending downwardly along the rear wall 116 about or not lower than the rear edge 118, thereby preventing, as discussed above, a shadow line to appear about the junction of the shelf 100 and the anchoring wall 20. Close to the front wall 112, the light casing 206 extends downwardly about or not lower than the front edge 114, thereby preventing one observer to see the light casing 206 when looking horizontally at the front of the shelf 100.

According to an embodiment, one embodiment of the diffuser film 211 is a nano-optic film (such as developed by Microsharp Corporation Limited as available at http://www.microsharp.co.uk/) disposed in front or over the surface of the LEDs 209. The nano-optic diffuser film 211 comprises shapes to reflect and direct the beam of light emitted by the LEDs 209 in a controlled light spreading angle. The nano-optic diffuser film 211 may further partially control the intensity of light transmitted in particular sub-portions of the spreading angle.

According to one embodiment, the light source 200 does not comprises a diffuser film 211. The LED 209, in this embodiment, extends in a lower position in the light casing 206. The beam of light emitted by the LED 209, through the discussed configuration of components, travels without any diffusing component in the directions discussed above, to illuminate the lit area A under the shelf 100.

Figure 3:
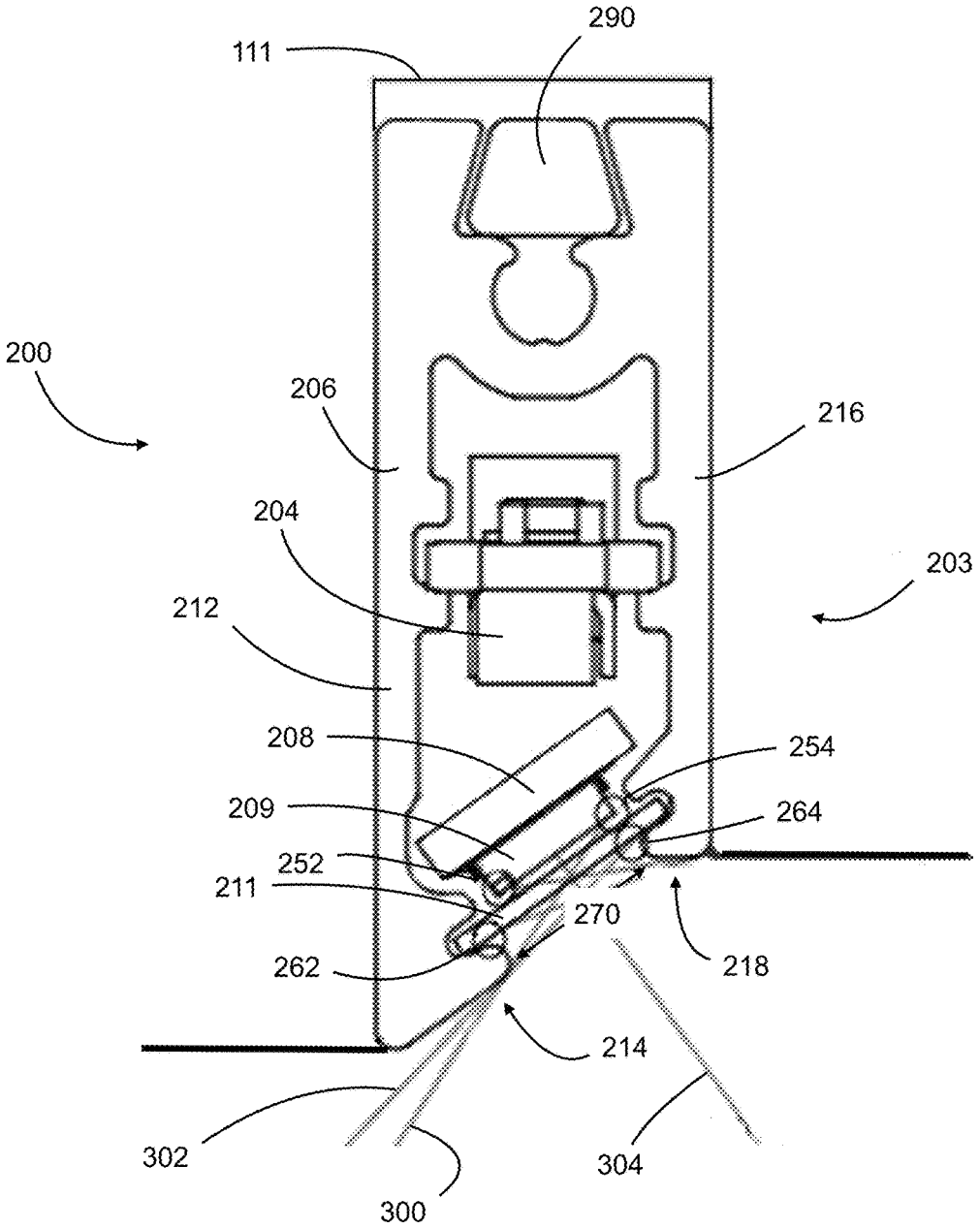
FIG. 3 is a closer close-up illustration of the lit shelf system illustrated on FIGS. 1 and 2.

Referring additionally to FIG. 3, the frontmost effective point 262 of the diffuser film 211 is positioned below (i.e., lower than) the rear edge 218, allowing the beam of light to spread backwardly and slightly upwardly, thus running alongside the rearmost underface 105. This orientation of the beam of light prevents, as discussed before, formation of a shadow line at the root of the shelf 100 near the wall 20.

It has to be noted that the external component of the lighting component 203, in the present embodiment the diffuser film 211, spans the opening 270 between the front edge 214 and the rear edge 218 of the casing 206. The lighting component 203 spanning the opening 270 provides a solution for securing the lighting component 203 in the casing and for maximizing the efficiency of the beams of light emitted by the lighting component 203 and lighting up the lit area A.

The lit area A on the other extremity is bordered by the lit border line 302 illustrating the limit of spreading of the beam of light extending from the rearmost effective diffuser point 264 to the front edge 214. A distinct lit border line 300 is defined by the beam of light extending from the rearmost LED point 254 to the front edge 214. It has to be noted that the portion of the lit area A between the rearmost underface 105 and the lit border line 300 is directly lit, without the light emitted by the LED 209 being required to be diffused or reoriented, while the portion of the lit area A between the lit border line 300 and the lit border line 302 is lit by light reoriented by the diffuser film 211. Thus, that portion of the lit area A is a dim lit area with respect to the remaining portion of the lit area A.

According to an embodiment, the angle defined by the rear underface and the direct border lit line 300 is the direct spread angle ß1. According to an embodiment, ß1 is about 122 degrees. According to an embodiment, ß1 is over about 100 degrees. According to an embodiment, ß1 is over about 110 degrees.

According to an embodiment, the angle defined by the rear underface and the dim border lit line 302 is the dim spread angle ß2. According to an embodiment, ß2 is about 132 degrees. According to an embodiment, the difference between ß1 and ß2 is about 10 degrees. According to an embodiment, the difference between ß1 and ß2 is less than about 20 degrees.

According to an embodiment, The LED 209 and the diffuser film 211 are oriented parallel to each other. A normal axis 304 (also referred to as a beam of light normal axis), perpendicular to the LED 209 and the diffuser film 211, is oriented in a direction which substantially downward and rearward. The normal axis 304, thus the normal orientation of the LED 209, is selected to optimize composing of direct and diffused light in the lit area A.

According to an embodiment, the normal axis 304 is of an angle of about 33.5 degrees relative to the vertical plane. That angle for the normal axis 304 is selected to re-direct the vertically projected beam of light from the LED 209 into the substantially backwardly and downwardly oriented light spreading angle.

According to an embodiment, the normal axis 304 is up to about 35 degrees relative to the vertical plane. According to another embodiment, the normal axis 304 is up to about 25 degrees relative to the vertical plane. According to another embodiment, the normal axis 304 is up to about 10 degrees relative to the vertical plane. It has to be noted that the "vertical plane" and thus the angles are defined relatively to the general orientation of the lighting face 103 of the shelf 100, in this case the lighting underface 103. It has further to be noted that the difficulty to efficiently prevent occurrence of a shadow line generally increases as the angle of the normal axis 304 decreases.

According to an embodiment, the direct light spreading angle ß1 provided with such a combination of a LED 209 and a diffuser film 211 is up to about 132 degrees, bordered on one side by the rearmost underface 105 and on the other side by the front edge 214. According to the same embodiment, the dim light spreading angle ß2 provided with such a combination of a LED 209 and a diffuser film 211 is up to about 152 degrees, bordered on one side by the rearmost underface 105 and on the other side by the front edge 214. According to the same embodiment, the rear-oriented direct lit border line 310 and dim lit border line 312, depending on the location of the frontmost LED point 252 and the frontmost effective diffuser point 262 relative to the rear edge 218, are less or about 10 and 20 degrees respectively relative to and above the rearmost underface 105. The low values of the direct lit border line 310 and dim lit border line 312 provide efficiency in the lighting of the lit area A while preventing undesired reflection effects that could result from a beam of light reflecting on the rearmost underface 105.

Figure 4:
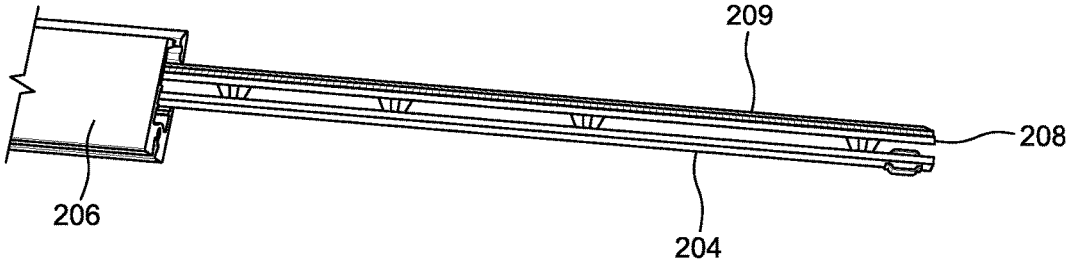
FIG. 4 is a picture illustrating a view of the combination of LEDs, PCB and driver partially slid out of the casing from a rear perspective according to its installation orientation.
Figure 5:
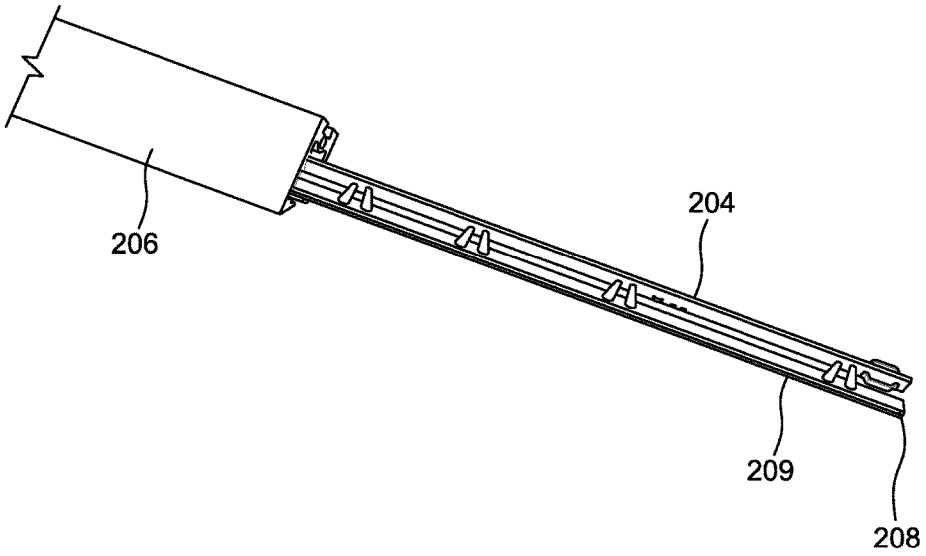
FIG. 5 is a picture illustrating a view of the components of FIG. 4 from a front perspective according to its installation orientation.
Figure 6:
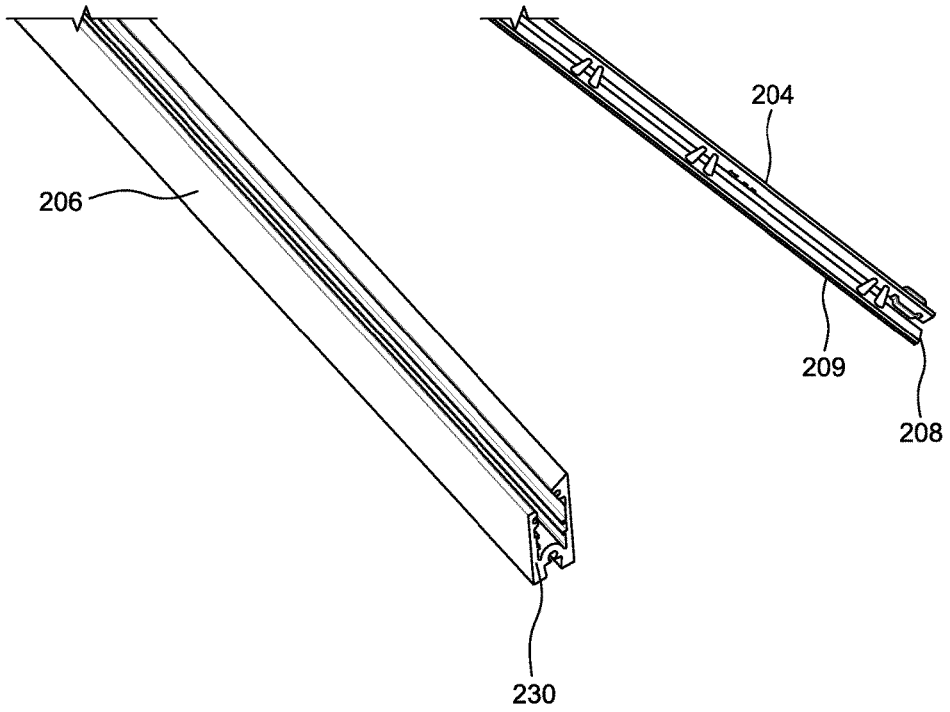
FIG. 6 is a picture illustrating a bottom view of the components of FIGS. 4 and 5 with the casing separated from the other components.

Referring now to FIGS. 4 to 6, FIGS. 4 and 5 provide views of the combination of LEDs 209, PCB 208 and driver 204 partially slid out of the casing 206 from rear and front perspectives respectively, according to the installation orientation. FIG. 6 illustrates the lighting components 203 slid out completely from the casing 206.

Referring more specifically to FIG. 6, embodiments of casings 206 may feature series of internal inward longitudinal grooves 230 (or lips) to adapt to a plurality of light sources 200 having specific configurations, such as mounting characteristics such as different distances between the PCB 208 and the driver 204, different width of PCB 208 or driver 204, or different angular orientations of LEDs 209.

Figure 7:
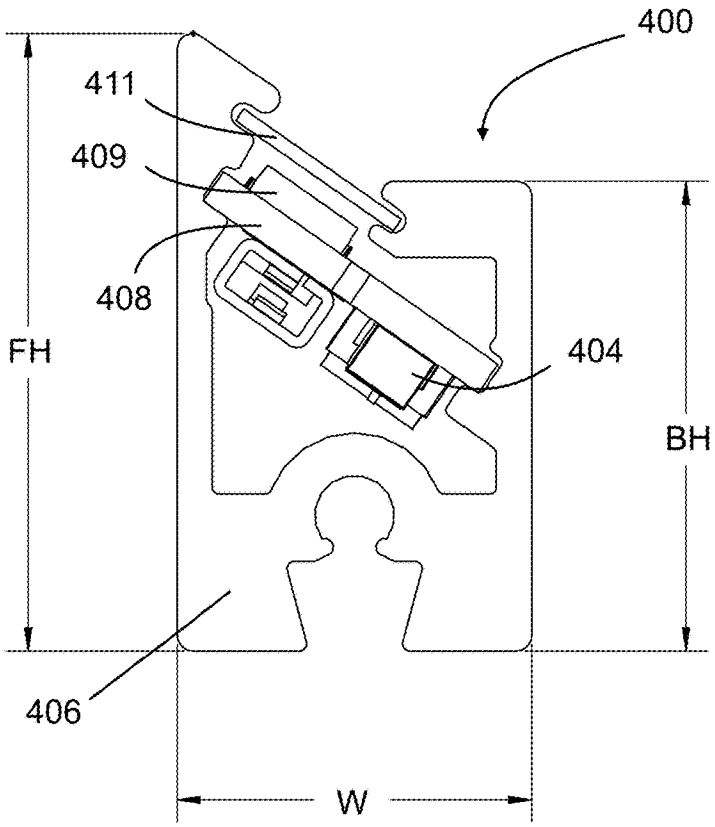
FIG. 7 is a close-up illustration of the side view of an embodiment of the lit shelf system pointing upward.

Referring now to FIG. 7, another embodiment for light source 400 comprises a wider casing 406 having a width W, a front height FH and a height BH, wherein the wider casing 406 is housing a LED 409 is a relatively similar configuration as the above-described embodiment for light source 200. Accordingly, the light source 400 comprises similar components as the above embodiments, namely a LED 409, a diffuser film 411, a PCB 408, a driver 404, all housed in the casing 406. According to this embodiment, the PCB 408 and the driver 404 are mounted as a combined manner providing the rigid structure to be mounted to the front wall 412 and rear wall 416 of the casing 406.

According to the embodiment of FIG. 7, the rear wall 416 of the light source 400 may measure about 0.330 of an inch while the front wall 412 measures about 0.434 of an inch of height, thus requiring as less as 0.330 of an inch of depth for the shelf groove as measures relative to the rear wall (not shown on FIG. 7, similar to rear wall 116 of groove 110 of FIGS. 1 to 3), and a difference of about 0.134 of an inch between the frontmost underface (not shown on FIG. 7, similar to frontmost underface 104 of FIGS. 1 to 3) and the rearmost underface (not shown on FIG. 7, similar to rearmost underface 105 of FIGS. 1 to 3) of the shelf 100. The width of the casing 406 may be about 0.250 of an inch for the embodiment illustrated on FIG. 7 and narrower for the embodiment illustrated on FIGS. 1 to 3.

Practically, selection of the first or the latter embodiment would be based on esthetic considerations, on space management considerations, and other considerations such as heat dissipation considerations. Selections of a particular solution for a specific use must therefore be performed considering such parameters.

It has to be mentioned that the shelf 100 may be made or composed of many materials, alone or in combination, that may be configured to provide the desired configuration and physical characteristics. Examples of such materials include, wood, steel and other metallic materials, glass and acrylics having been submitted to processes rendering them opaque or tainted in at least particular portions to prevent one observer from being able to see the casing 206 and other lighting components, etc.

It has to be mentioned that the casings 206, 406 may be made or composed of many materials, alone or in combination, that may be configured to provide the desired configuration and physical characteristics allowing the casings 206, 406 to be housed and to remain in the groove 110 as to resist to the heat emitted by the light source 200, 400. Examples of such materials include, heat-resistant plastic, heat-resistant rubber, steal and other metallic materials, etc.

It further has to be mentioned that even though the PCB 208 and the driver 204 are illustrated as discrete components in the described embodiments, alternative embodiments may present the PCB 208 and the driver 204 as a single physical component. For example, the wider casing 406 illustrated on FIG. 7 may accept a wider PCB 408 housing the driver 404.

It is without mentioning that even if no mention of the power source feeding the light sources 200, 400 has been discussed in relation with embodiments, many known power sources may provide power necessary for the operation of the light sources 200, 400. Additional components may further be present between the power source and the light source, such as a switch, a dimmer, electric cables, circuit breaks, etc. for proper operation of the light sources 200, 400.

According to an embodiment, there is described a light source (200/400) to be encased to a shelf (100), the light source (200/400) comprising:

- a casing (206/406) to be encased into the shelf (100), the casing (206/406) comprising:
  - a front wall (212) ending with a front edge (214);
  - a rear wall (216) ending with a rear edge (218);
  - wherein the front wall (212) and the rear wall (216) are to be partially encased into the shelf (100); and
  - an opening (270) between the front edge (214) and the rear edge (218);
  - wherein the casing (206/406) when encased into the shelf (100) has the front wall (212) stretching further from the shelf (100) than the rear wall (216); and
- a lighting component (203) mounted to the casing (206/406) emitting a beam of light bordered by the shelf (100) and the front edge (214),
- wherein the lighting component (203) spans the opening (270), and
- wherein the lighting component (203) is stretching away from the shelf (100) past the rear edge (218) but not past the front edge (214).

According to an aspect, the light source (200/400) further comprises inward abutment surfaces (222,224,226,228) for mounting the lighting component (203) to the casing (206/406).

According to an aspect, the light source (200/400) further comprises a mounting wall and a magnet strip (290) mounted to the mounting wall, wherein the magnetic strip (290) is adapted to secure the light source (200/400) to a metal strip mounted to the shelf (100).

According to an aspect, the light source (200/400) further comprises bias component, wherein the bias component is mounted outwardly to one of the front wall (212) and the rear wall (216).

According to an aspect, the opening (270) is narrower than the lighting component (203).

According to an aspect, the light source (200/400) further comprises inward grooves (230).

According to an aspect, the lighting component (203) comprises at least one lighting sub-component selected in the group comprising: a driver (204), a PCB (208) a light emitting component (209), and a diffuser film (211), and wherein one of the lighting sub-component is slidable mounted to the casing (206/406).

According to an aspect, the lighting component (203) emits a beam of light spreading about at least 100 degrees.

According to an aspect, the lighting component (203) comprises a light emitting component (209) and a diffuser film (211) parallel with each other.

According to an aspect, proximity between the light emitting component (209) and the diffuser film (211) prevents the light beam emitted by the light emitting component (209) to reflect over the casing (206/406) before reaching the diffuser film (211).

According to an embodiment, there is described a lit shelf system (10) for lighting up a lit area (A), comprising:

- a shelf comprising:
  - a front face (102);
  - an lighting face (103) bordering the lit area (A), the lighting face (103) comprising a frontmost face (104)

and a rearmost face (105) further distant from the front face (102) than the frontmost face (104); and a groove (110) comprising a bottom (111), the groove (110) being bordered by the frontmost face (104) at a front edge (114) and by the rearmost face (105) at a rear edge (118), with the front edge (114) extending further away from the bottom (111) than the rear edge (118); and a light source (200/400) mounted to the groove (110) lighting up the lit area (A), the light source (200/400) spanning between the front edge (114) and the rear edge (118), and stretching away from the bottom (111) past the rear edge (218) while not past the front edge (114).

According to an aspect, the lit shelf system further comprises a mounting wall and a magnet strip (290) mounted to the mounting wall, and a metal strip mounted to the groove (110), wherein the magnetic strip (290) is adapted to secure the light source (200/400) to the metal strip.

According to an aspect, the light source comprises a lighting component (203) comprises a light emitting component (209) and a diffuser film (211) mounted parallel with each other.

According to an aspect, proximity between the light emitting component (209) and the diffuser film (211) prevents light emitted by the light emitting component (209) to reflect over the casing (206/406) before reaching the diffuser film (211).

According to an aspect, the groove (110) is distant from the front face (102).

According to an embodiment, there is described a lit shelf system (10) for lighting up a lit area (A), comprising:

a shelf (100) comprising:

a front face (102);

an lighting face (103) bordering the lit area (A), the lighting face (103) comprising a frontmost face (104) and a rearmost face (105) further distant from the front face (102) than the frontmost face (104); and a groove (110) comprising a bottom (111), the groove (110) being bordered by the frontmost face (104) at a front edge (114) and by the rearmost face (105) at a rear edge (118), with the front edge (114) extending further away from the bottom (111) than the rear edge (118); and a light source (200/400) mounted to the groove (110) for emitting a beam of light lighting up the lit area (A), the beam of light running alongside the rearmost face (105) on one side and its spread being limited to a spreading angle ß of over 100 degrees relative to the rearmost face (105).

According to an aspect, the light source (200/400) further comprising a mounting wall and a magnet strip (290) mounted to the mounting wall, and a metal strip mounted to the groove (110), wherein the magnetic strip (290) is adapted to secure the light source (200/400) to the metal strip.

According to an aspect, the light source (200/400) comprises a lighting component (203) comprises a light emitting component (209) and a diffuser film (211) mounted parallel with each other.

According to an aspect, the lighting source (200/400) further comprises a casing (206/406) and wherein proximity between the light emitting component (209) and the diffuser film (211) prevents light emitted by the light emitting component (209) to reflect over the casing (206/406) before reaching the diffuser film (211).

According to an aspect, the lighting source (200/400)) comprises a casing (206/406) and at least one lighting sub-component selected in the group comprising: a driver (204), a PCB (208), a light emitting component (209), and a diffuser film (211), and wherein one of the lighting sub-component is slidable mounted to the casing (206/406).

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A lit shelf system comprising:

a shelf having a front face, a lighting face extending horizontally, a dark face opposite the lighting face and a groove, the groove having a front wall extending to a front edge about the lighting face and a rear wall extending to a rear edge about the lighting face, the front wall being closer to the front face than the rear wall and the front wall extending further from the dark face than the rear wall; and a light source mounted in the groove and for lighting a space about the lighting face, the light source extending between the front wall and the rear wall past the rear edge but not past the front edge.

2. The lit shelf system of claim 1, wherein the groove is within the lighting face.

3. The lit shelf system of claim 2, wherein lighting face comprises a frontmost face and a rearmost face on either side of the groove, the frontmost face being closer to the front face than the rearmost face.

4. The lit shelf system of claim 3, wherein the front wall extends further from the dark face than the rear wall by a given distance, further wherein the frontmost face extends from the dark face by a given thickness, wherein the given distance represents less than 3% of the given thickness.

5. The lit shelf system of claim 3, wherein the front wall extends further from the dark face than the rear wall by a given distance, further wherein the frontmost face extends from the dark face by a given thickness, wherein the given distance represents less than 5% of the given thickness.

6. The lit shelf system of claim 3, wherein the front wall extends further from the dark face than the rear wall by a given distance, further wherein the frontmost face extends from the dark face by a given thickness, wherein the given distance represents less than 10% of the given thickness.

7. The lit shelf system of claim 1, wherein the front wall and the rear wall extends substantially vertically.

8. The lit shelf system of claim 1, wherein the front wall and the rear wall extends substantially vertically and straight.

9. The lit shelf system of claim 1, wherein when the light source is mounted within the groove the light source does not extend past the front edge.

10. The lit shelf system of claim 1, wherein the light source is mounted within the groove by friction.

11. The lit shelf system of claim 1, wherein the space lit by the light source spreads over an angle of coverage in a plane which is normal to both the front face and the lighting face, the angle of coverage having a central axis directed substantially away from the shelf and in a direction opposite the front face.

12. The lit shelf system of claim 1, wherein the space lit by the light source spreads over an angle of coverage in a plane which is normal to both the front face and the lighting face, the angle of coverage being greater than 100 degrees.

13. The lit shelf system of claim 1, wherein the space lit by the light source spreads over an angle of coverage in a plane which is normal to both the front face and the lighting face, the angle of coverage being greater than 130 degrees.

14. The lit shelf system of claim 1, wherein the light source further comprises a casing and light emitting component mounted within the casing.

15. The lit shelf system of claim 14, wherein the light source further comprises a diffuser film mounted within the casing to diffuse the light emitted by the light emitting component.

16. The lit shelf system of claim 14, further comprising a magnet and wherein the light source is mounted within the groove using an electromagnetic force holding the casing within the groove.

17. The lit shelf system of claim 14, wherein the lighting component comprises one or more LEDs.

18. The lit shelf system of claim 14, wherein the space lit by the light source spreads over an angle of coverage in a plane which is normal to both the front face and the lighting face, the angle of coverage having a central axis directed substantially away from the shelf and in a direction opposite the front face, wherein the casing comprises a front wall ending at a front edge wherein the angle of coverage is limited in one direction by lighting face and another direction by a border line which is limited by the front edge.

19. The lit shelf system of claim 18, wherein the central axis and the border line define an angle which is 70 degrees or more.

20. The lit shelf system of claim 1, wherein the front wall and the rear wall extend downwardly and the lighting space is below the shelf.

* * * * *